US006146316A

United States Patent [19]

Carolus et al.

[11] Patent Number: 6,146,316

[45] Date of Patent: Nov. 14, 2000

[54] CONVERTIBLE USER MANIPULATED FORCE RESISTING APPARATUS

[76] Inventors: Jeffrey W. Carolus, 56 Broadbrook Rd., Broadbrook, Conn. 06016; James Richardson, 34 Ladder Hill Rd. South, Weston, Conn. 06883

[21] Appl. No.: 09/385,813

[22] Filed: Aug. 30, 1999

[51] Int. Cl.[7] ..... A63B 21/06

[52] U.S. Cl. ..... 482/98; 482/100; 482/103; 482/138; 482/904

[58] Field of Search ..... 482/94, 97–103, 482/133, 136–138, 904, 910

[56] References Cited

U.S. PATENT DOCUMENTS

| | | |
|---|---|---|
| 2,632,645 | 3/1953 | Barkschat . |
| 3,127,171 | 3/1964 | Noland et al. . |
| 4,913,423 | 4/1990 | Farran et al. . |
| 5,743,050 | 4/1998 | Shibata . |

FOREIGN PATENT DOCUMENTS

| | | | |
|---|---|---|---|
| 92/07629 | 5/1992 | WIPO | 402/101 |

*Primary Examiner*—John Mulcahy

*Attorney, Agent, or Firm*—McCormick, Paulding & Huber LLP

[57] ABSTRACT

In a convertible user manipulated force resisting apparatus an articulated frame includes a base and a weight carrying member supported thereon for movement between an active position wherein the weight carrying member extends upwardly, and an inactive position wherein said weight carrying member is generally horizontally disposed relative to the base. The weight carrying member can be releasably retained in the active position by a pin or other means. A plurality of discreet weights are releasably secured to the weight carrying member for reciprocal motion relative thereto. A bench is coupled to the frame adjacent to the weight carrying member for movement between a first position substantially perpendicular to the weight carrying member when in the active position, and a second position approximately parallel to the weight carrying member when in the inactive position. Various mechanisms are provided for selectively moving at least one of weights between a lowered and a raised position. When not being used as an exercise apparatus the weight carrying member and the bench can be concealed, thereby converting the exercise apparatus to an article of furniture ie. g., a sofa adapted to support at least one person in a seated position.

11 Claims, 7 Drawing Sheets

CONVERTIBLE USER MANIPULATED FORCE RESISTING APPARATUS

FIELD OF THE INVENTION

The present invention relates generally to exercise equipment, and is more specifically directed to equipment convertible from an exercising configuration to an article of furniture adapted to support at least one person in a seated position.

BACKGROUND OF THE INVENTION

For a variety of different reasons, such as time constraints, privacy, or convenience, people often prefer to exercise in their own homes. In an effort to address this situation, there has been in recent years a proliferation of various different types of exercising apparatus for home use. Most of this equipment is of the stand alone type and requires that a person either leave the equipment out in the open, or have an area in which the equipment can be stored when not in use. While some of these devices may collapse to a configuration requiring less storage space, nevertheless, a person must still allocate an accessible storage location for the equipment. In contrast, some types of equipment, such as, for example, sets of weights and the benches used in connection therewith do not lend themselves to relocation for storage, as the weights are inherently quite heavy and the benches tend to be very cumbersome.

The problem of finding a place to store the exercise equipment or alternatively allocating a location wherein the equipment can be permanently located is exacerbated by the fact that people often live in apartments or crowded homes where sufficient storage or free space is simply not available. Accordingly, people in these situations do not buy exercise equipment, or they are forced to go to a gymnasium or join a health club in order to be able to work out on exercise equipment. Often, due to the inconvenience associated with having to travel to and from the gym, these persons forgo exercising altogether which can pose significant health problems.

Based on the foregoing, it is the general object of the present invention to provide an exercising apparatus that overcomes the difficulties and drawbacks of prior art exercising equipment.

It is a more specific object of the present invention to provide an exercising apparatus for home use that, when not functioning as exercise equipment, is convertible to an article of furniture adapted to support at least one person in a seated position.

SUMMARY OF THE INVENTION

The present invention is directed to a convertible user manipulated force resisting apparatus that includes an articulated support frame having a base and a weight supporting member coupled to the base for movement between an active position wherein the weight supporting member is approximately upright and an inactive position wherein the weight supporting member is generally horizontally disposed relative to the base. Suitable means are provided for releasably retaining the weight supporting member in the active position, thereby preventing it from toppling during use. A plurality of discreet weights are releasably mounted on the weight supporting member for reciprocal movement between a raised and lowered position when the weight supporting member is in the active position. Various means for a user to selectively move one or more of the plurality of weights between the raised and lowered positions are also included, thereby allowing a user to perform multiple exercises wherein the user's body provides a counter resisting force to the weights being moved.

A bench for supporting a person thereon is pivotally coupled to the base for movement between a first position wherein the bench is adjacent and approximately perpendicular to the weight supporting member in the active position, and a second position wherein the bench is approximately parallel to the weight supporting member in the inactive position. To allow a person to reclaim the space occupied by the force resisting apparatus of the present invention, means are included for concealing the weight retaining member and the bench in the inactive and second positions, respectively, thereby converting the apparatus into an article of furniture adapted to support at least one person in a seated position.

In one embodiment of the present invention, the means for concealing the exercising equipment includes a support frame mounted to the base of the articulated frame and moveable between a folded and an unfolded position. When in the folded position, the support frame forms a substantial part of the article of furniture and defines an interior area wherein the exercise apparatus with the weight supporting member in the inactive position and the bench in the second position, is located. In the unfolded condition, the interior area is exposed such that the weight carrying member and the bench can be moved to the active and second positions respectively.

Preferably, the support frame includes an upstanding backrest section attached to the base, and at least one upstanding side panel coupled to the base and in communication with the backrest. At least one front panel is hingedly attached to the base opposite the backrest section, for movement between a raised position and a lowered position, allowing access to the exercise apparatus. With the support frame in the folded condition, at least one back cushion and at least one seat cushion is releasably positionable on the support frame.

In another embodiment of the present invention, the weight retaining member in the inactive position forms the backrest, for the article of furniture upon which the back cushions can be releasably mounted. Seat cushions are releasably mounted to the bench when in the second position, thereby causing the exercise apparatus to form the article of furniture for supporting at least one person in a seated position.

In the present invention, the means for moving one or more of the plurality of weights between the raised and lowered positions includes a plurality of different moveable interface elements for multiple exercises. For example, in one aspect, a pair of levers each including a handle portion, pivotally coupled to the bench and selectively moveable about a pivot axis between an approximately upright position and a collapsed lower position are provided and include means for releasably securing the levers in a plurality of locations between the upright and collapsed lower position.

The levers are coupled via suitable means, such as a flexible cable, to one or more of the plurality of weights. Accordingly, with the levers releasably secured in one of the above-described plurality of locations, the reciprocal motion of the weights can be accomplished by a user by manually moving the levers about the pivot axis between a forward and rearward position.

The means for moving one or more of the plurality of weights between the raised and lowered positions can also include a bar mounted to an upper portion of the weight supporting member and moveable between a non-working position wherein the bar is adjacent and approximately parallel to the weight supporting member, and a working position wherein the bar extends from and is approximately perpendicular to the weight supporting member.

A first pulley is rotatably mounted to an end of the bar, with a second pulley being rotatably mounted to the weight supporting member. A flexible cable extends around and slidably engages each of the pulleys and can be selectively coupled at one end to one or more of the plurality of weights, and at another end to gripping means, such as a handle bar, are located adjacent to the bar in the working position. Pulling on the bar allows a user to move the weights to which the cable is attached, between the lowered and raised positions while the user supplies a resisting force when allowing the weights to move between the raised and lowered positions.

DETAILED DESCRIPTION OF THE PREFERRED EMBODIMENTS

Figure 1:
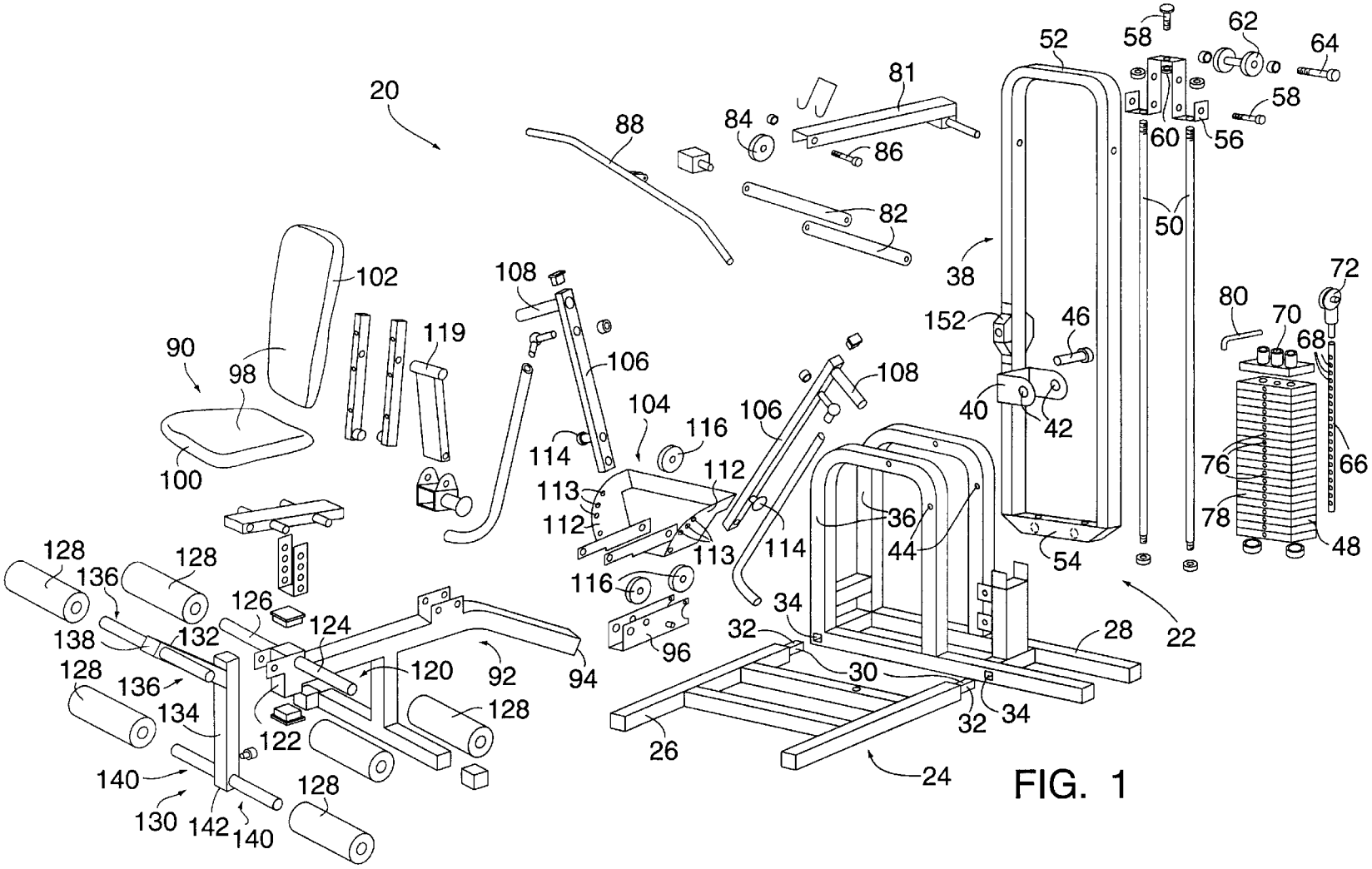
FIG. 1 is a partial exploded view of the user manipulated force resisting apparatus of the present invention showing the weight retaining member in the active position and the bench in the first position.

An embodiment of the convertible user manipulated force resisting apparatus of the present invention generally designated by the reference number 20 is shown in FIG. 1 and includes an articulated frame 22. The articulated frame 22 comprises a base 24 having a first base section 26 and a second base section 28. The first base section 26 is adapted to be supported on a substantially horizontal surface, such as, a floor, and includes a pair of spaced apart tubular extensions 30 each defining a shaped outer periphery 32 adapted to slidably engage an aperture 34 defined by the second base section having a shape complimentary to the outer periphery 32 of the tubular extensions 30.

A pair of substantially upstanding supports 36 are attached to the second base section 28 in spaced apart relation relative to each other for pivotally supporting a weight carrying member 38 thereon. In the illustrated embodiment, the weight carrying member 38 consists of an elongated tubular frame having a clevice-type bracket 40 attached thereto, defining a pair of opposed apertures 42 that extend through the bracket. Each aperture 42 aligns with a mating aperture 44 in a respective one of the upstanding supports 36. A pin 46, or a fastener, such as a bolt, extends through the apertures 42 and 44 thereby pivotally mounting the weight supporting member 38 to the base 24. As will be explained in detail herein below, the weight supporting member 38 is pivotally moveable between an active position (as shown in FIG. 1), and an inactive position.

Still referring to FIG. 1, a plurality of discreet, plate-like weights 48 slidably mount for reciprocal movement between a raised and a lowered position onto a pair of guides 50 that in turn are secured to an upper and lower portion, 52, and 54 respectively of the weight retaining member 38. The guides 50 are secured to the upper portion 52 of the weight retaining member 38 via a bracket 56 attached to the weight retaining member by three fasteners, shown in the illustrated embodiment as bolts 58 (only two shown), and nuts 60. A pulley 62 is rotatably mounted on the bracket 56 using pin 64, and is positioned above the plurality of weights 48.

An elongated rod 66 defining a plurality of apertures 68 extending along its length is adapted to be slidably received in a passage 70 defined by an aperture extending through each of the weights 48, the aperture in each weight is substantially aligned with the apertures in any underlying weights. A plurality of holes 76 extend from a front face 78 of the plurality of weights 48, to the above-described passage 70. Each of the holes 76 is defined in part by one weight, and in part by the next successive underlying weight. A key 80 is adapted to selectively extend into one of the holes 76 and engage the rod 66 via one of the apertures 68 defined by the rod. During operation a user selects the amount of weight to be worked with by positioning the key 80 into the appropriate hole 76, thereby coupling all of the weights above the key 80, to the rod. Another pulley 72, the function of which will be explained below, is coupled to an end of the rod 66 below, and approximately aligned with, the pulley 62.

As shown in FIG. 1, an arm 81 is pivotally attached to the upper portion 52 of the weight supporting member 38 for movement between a nonworking position, and a working position (shown in FIG. 1) wherein the bar extends from, and is approximately perpendicular to the weight carrying member 38 when the weight carrying member is in the active position. A pair of struts 82 are pivotally attached at one end to the weight carrying member 38 and can be releasably coupled at an opposite end to the arm 81 such that the arm is releasably retained in the working position. A pulley 84 is rotatably attached to the end of the arm 81 by pin 86 and is approximately aligned with the pulley 62 when the arm is in the working position.

With the weight retaining member 38 in the active position, and the arm 81 in the working position, a flexible cable (not shown) extends around, and slidably engages the pulleys 62, 72, and 84, and is releasably coupled to a handlebar 88. During operation, a user can grip the handlebar 88 and by pulling thereon cause the flexible cable to move the rod 66 and thereby one or more of the plurality of weights 48 coupled thereto by the key 80, between the raised and lowered position. While a handlebar 88 has been shown and described, the present invention is not limited in this regard as other gripping means such as but not limited to individual handles or ropes, can be substituted without departing from the broader aspects of the present invention.

Still referring to FIG. 1, a bench generally designated by the reference number 90 includes a frame 92 having an end 94 attached to a bracket 96 which in turn is rotatably coupled to the first base section 26. This allows the bench 90 to be movable between a first position, as shown in FIG. 1, wherein the bench is approximately perpendicular to the weight retaining member 38 when in the active position, and a second position where, as explained in detail below, the bench is approximately parallel to the weight retaining member in the inactive position.

The bench 90 includes an articulated support surface 98 having a stationary section 100 and an adjustable section 102 which in combination are adapted to support a user in positions ranging from completely reclined to sitting. A lever support bracket 104 is coupled to the bench frame 92, and a pair of levers 106, one positioned on each side of the bench 90 are pivotally and adjustably mounted to the lever support bracket. Each lever includes a handle 108 extending therefrom, and is selectively moveable between a collapsed position wherein the handles are supported on the surface on which the bench frame 92 rests, e.g. a floor, and an approximately upright position as shown in FIG. 1.

The lever support bracket 104 includes a pair of opposed side walls 112 spaced apart relative to one another, each being located adjacent to an opposing side of the bench 90. Each side wall 112 defines a plurality of apertures 113 extending therethrough with each aperture on one side wall being substantially aligned with a corresponding aperture on the other side wall. Each lever 106 includes a spring loaded pin 114 attached thereto and selectively alignable with each of the apertures 113. During use, each lever is releasably secured in a desired position by drawing back on the associated spring loaded pin 114 and moving the lever until the spring loaded pin 114 is aligned with one of the apertures 113. Releasing the spring loaded pin 114 causes the pin to extend into the aperture 113, thereby releasably securing the lever in place.

Still referring to FIG. 1, at least a pair of pulleys 116 are rotatably mounted to the lever support bracket 104. During operation, a flexible cable (not shown) is coupled at one end to the levers 106, and extends under pulleys 116 over pulley 62 and around pulley 72. A person uses the levers 106 by sitting on the bench 90 and facing the weight supporting member 38. The person then grasps the handles 108 on this lever and pulls the levers toward him/her. The movement of the levers 106 between an extended and resting position, causes the weights 48 coupled to the rod 66 via key 80, to be moved between the raised and lowered position. A bench press handle 119 is pivotally coupled to each lever 106 and is adapted for use by a person seated on the bench 90 with his/her back against the adjustable section 102 of the articulated support surface 98.

A first cross member 120 is attached to an end 122 of the bench frame 92 and includes first and second sections, 124 and 126 respectively which extend perpendicularly from the bench frame in opposite directions. A generally cylindrical cushion 128 is slidably positioned over each of the first and second sections, 124 and 126 respectively, of the cross member 120 and as explained below protect the legs of a person using the equipment from being injured by the cross member 120. A force transmitting linkage 130 is pivotally coupled to the bench frame 92 adjacent to the first cross member 120, for movement between a raised and a lowered position. The force transmitting linkage 130 is also operatively coupled to the rod 66 via a flexible cable (not shown) such that movement of the linkage between the raised and lowered positions causes the weights 48 coupled to the rod 66 by the key 80 to move between a corresponding raised and lowered position.

The force transmitting linkage 130 includes an upper leg 132 extending outwardly from the bench frame 92, and a lower leg 134 approximately perpendicular, when the linkage is in the lowered position, to the substantially horizontal surface upon which the bench frame 92 is supported. A first pair of actuating members 136 are approximately perpendicular to, and extend in opposite directions from, an end 138 of the upper leg 132 of the force transmitting linkage 130. Similarly, a second pair of actuating members 140 are approximately perpendicular to, and extend in opposite directions from, an end 142 of the lower leg 134 of the force transmitting linkage 130. A cylindrical cushion 128 is slidably positioned over each actuating member of the first and second pairs of actuating members, 136 and 140 respectively.

During operation, a user can perform an exercise referred to as leg extensions, from a seated position on the bench 90 by positioning his/her legs over the cushion 128 mounted on the cross member 120 and his/her feet behind the second pair of actuating members 140. The user then extends his/her legs thereby moving the force transmitting linkage and the weights coupled to the rod 66, between the lowered and raised positions. Alternatively, the user can lie on his/her stomach on the bench 90 and position his/her heals under the first pair of actuating members 136 and by curling his/her legs upward, move the force transmitting linkage 130 and the weights 48 coupled to the rod 66, between the lowered and raised positions.

Figure 2:
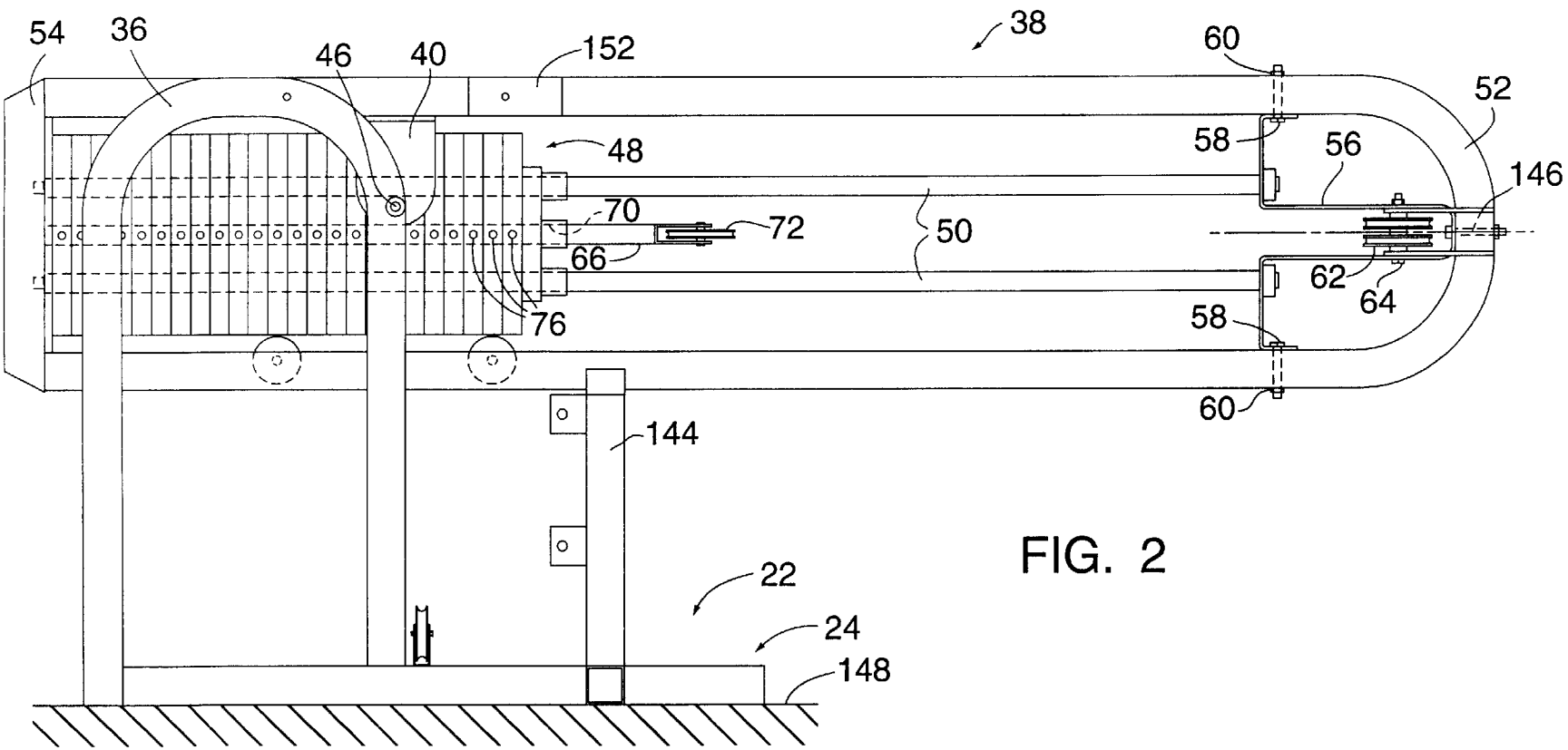
FIG. 2 is a front elevational view of the articulated support frame of the user manipulated force resisting apparatus of FIG. 1 showing the weight carrying member in the inactive position.
Figure 3:
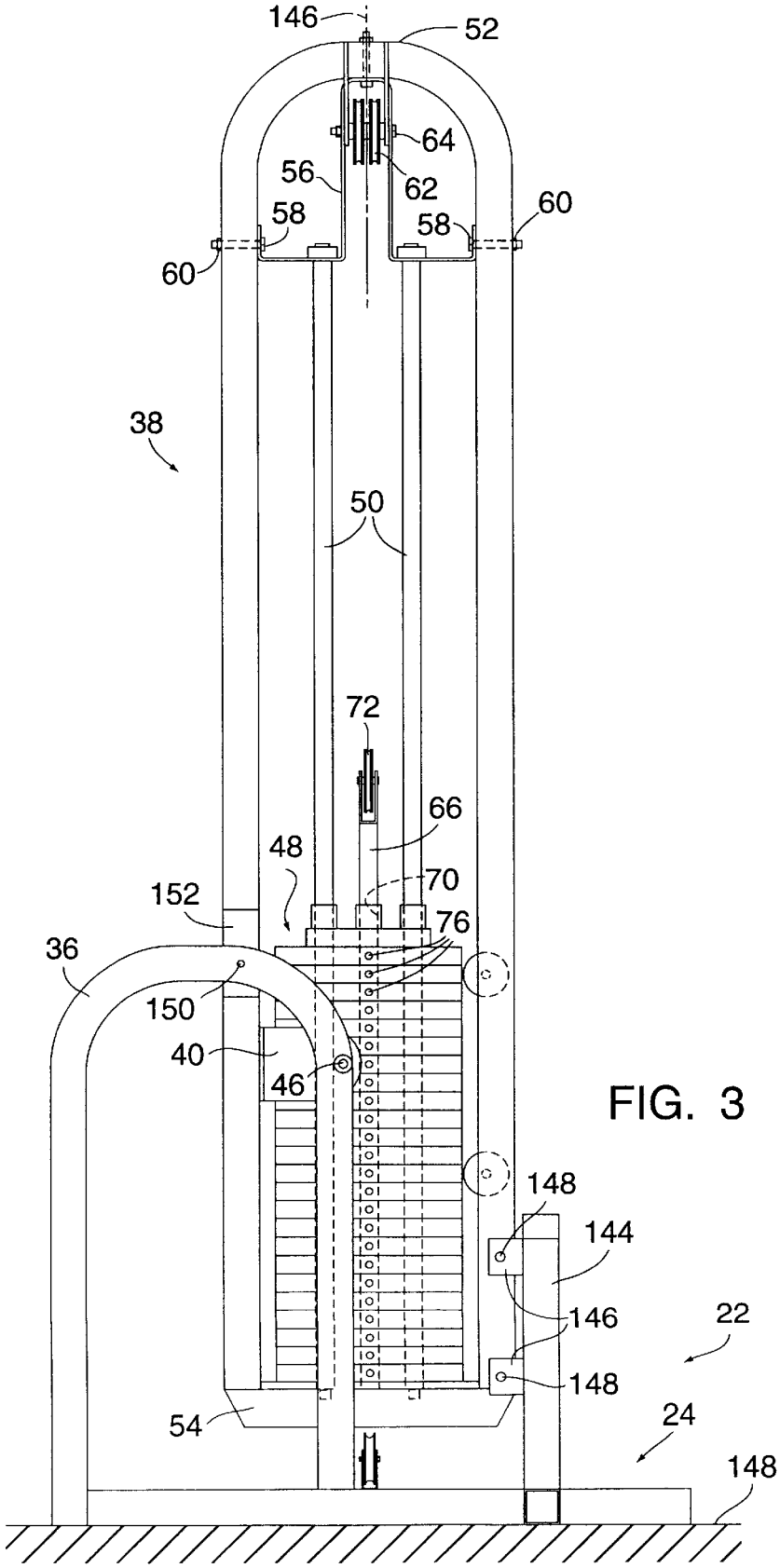
FIG. 3 is a front elevational view of the articulated support frame of the user manipulated force resisting apparatus of FIG. 1 showing the weight carrying member in the active position.

FIGS. 2 and 3 illustrate the articulated support frame 22 with the weight retaining member 38 having the plurality of discreet weights 48 slidably mounted thereon, in the inactive and active positions respectively. The weights 48 are positioned on the weight retaining member 38 in a manner such that they function as a counter balance allowing a user to easily move the weight retaining member between the active and inactive positions. An upstanding saddle 144 is attached to the base 24 and supports the weight carrying member 38 in the inactive position, such that the longitudinal axis 146 of the weight carrying member is generally horizontal and approximately parallel to the surface 148 upon which the base 24 is located.

As shown in FIG. 3, the weight supporting member 38 is releasably retained in the active position by a pair of tabs 146 and fasteners 148. The tabs 146 are attached to and extend from the saddle 144 and are adjacent to the weight supporting member 38 when in the active position. The fasteners 148 extend through the tabs 146 and threadably engage the weight supporting member 38 thereby retaining the weight supporting member in the active position. To further support the weight retaining member 38 in the active position, a pair of fasteners 150 (one shown) extend through the tubular extensions 32 and threadably engage a boss 152 attached to the weight supporting member 38.

Figure 4:
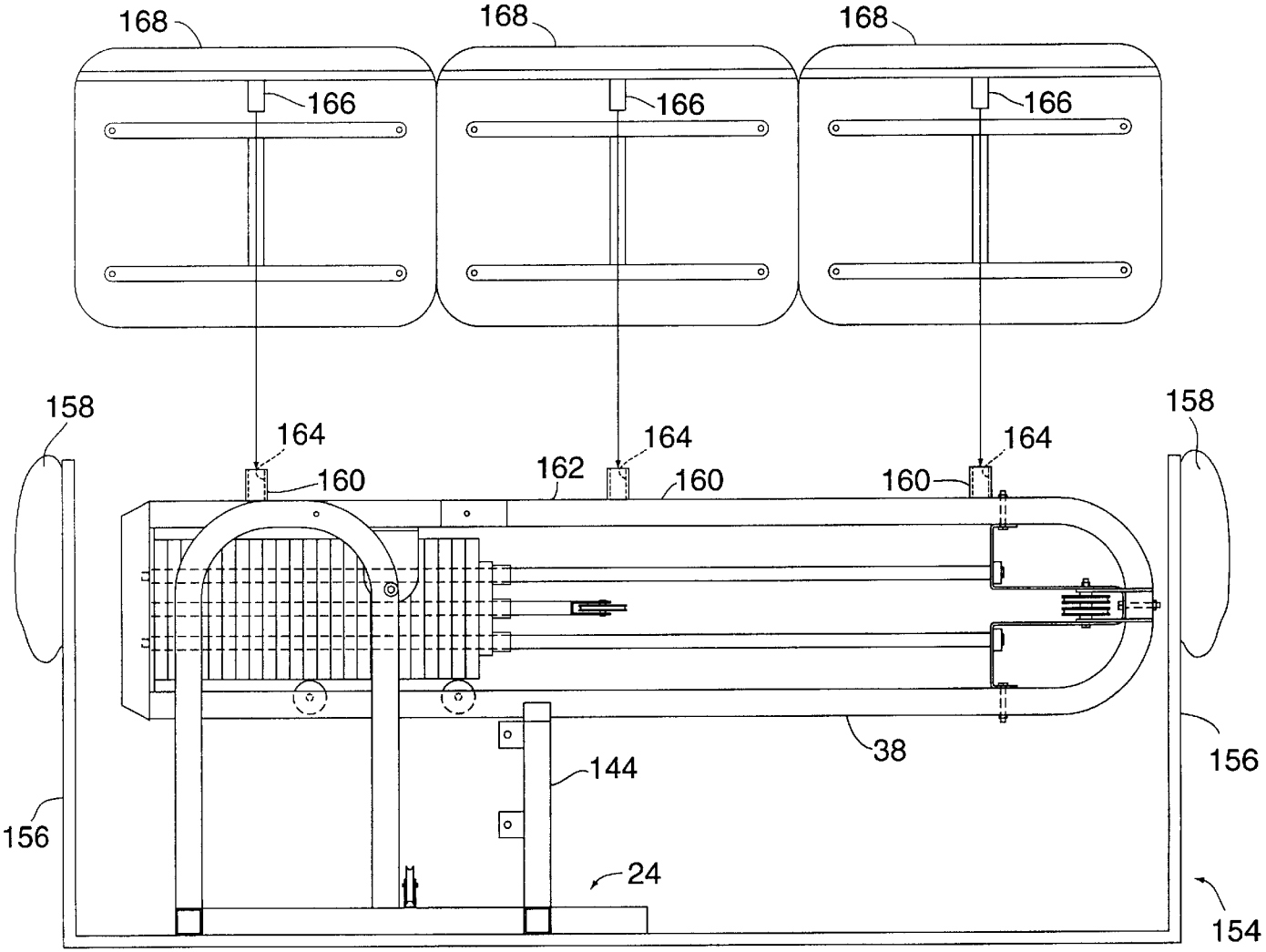
FIG. 4 is a partially exploded rear elevational view of the user manipulated force resisting apparatus of FIG. 1 illustrating the manner in which the back support cushions are releasably mounted onto the weight supporting member.
Figure 5:
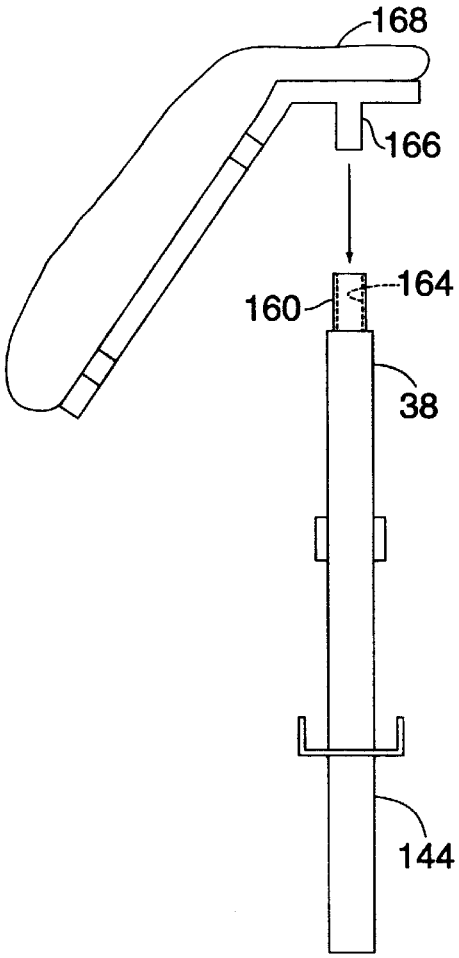
FIG. 5 is a partially exploded side elevational view of the convertible exercise apparatus of FIG. 1 illustrating the manner in which the back support cushions are releasably mounted onto the weight supporting member.

As shown in FIG. 4, the force resisting apparatus 20 of the present invention, is supported on a furniture frame 154 that includes a pair of opposed upstanding side walls 156 each having an armrest cushion 158 mounted thereon. Three hollow mounting receptacles 160 are attached in an equally spaced relationship relative to one another to a top edge portion 162 of the weight retaining member 38 in the inactive position. Each of the mounting receptacles 160 defines an internal area 164, shown in dotted lines, adapted to slidably receive a mounting member 166 coupled to a backrest cushion 168, best seen in FIG. 5. The mounting members 166 each define an outer peripheral surface of a shape complimentary to the interior area 164 of a respective one of the mounting receptacles 160. The backrest cushions 168 act to conceal the weight retaining member 38.

Figure 6:
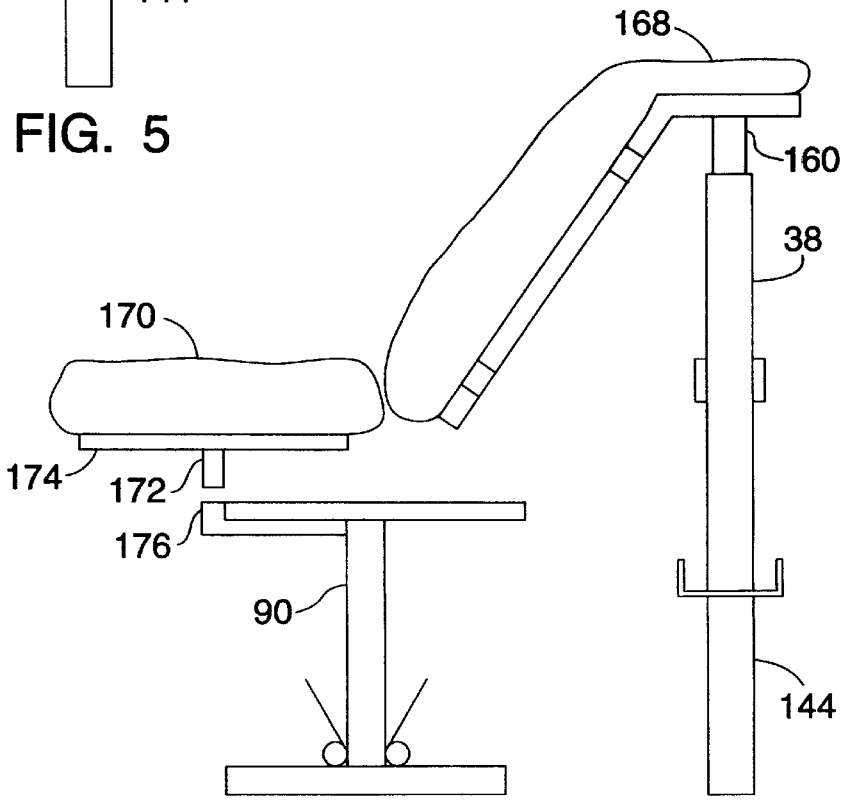
FIG. 6 is a partially exploded side elevational view of the user manipulated force resisting apparatus of FIG. 1 illustrating the manner in which the seat cushions are releasably mounted onto the bench.

Referring to FIG. 6, with the bench 90 in the second position approximately parallel to the weight retaining member 38 in the inactive position, three seat cushions 170 can be mounted to the bench by slidably positioning a boss 172 extending from a bottom surface 174 of the seat cushion, into a mating retainer 176 defined by the bench 90. In this manner, the bench 90 is concealed.

Figure 7:
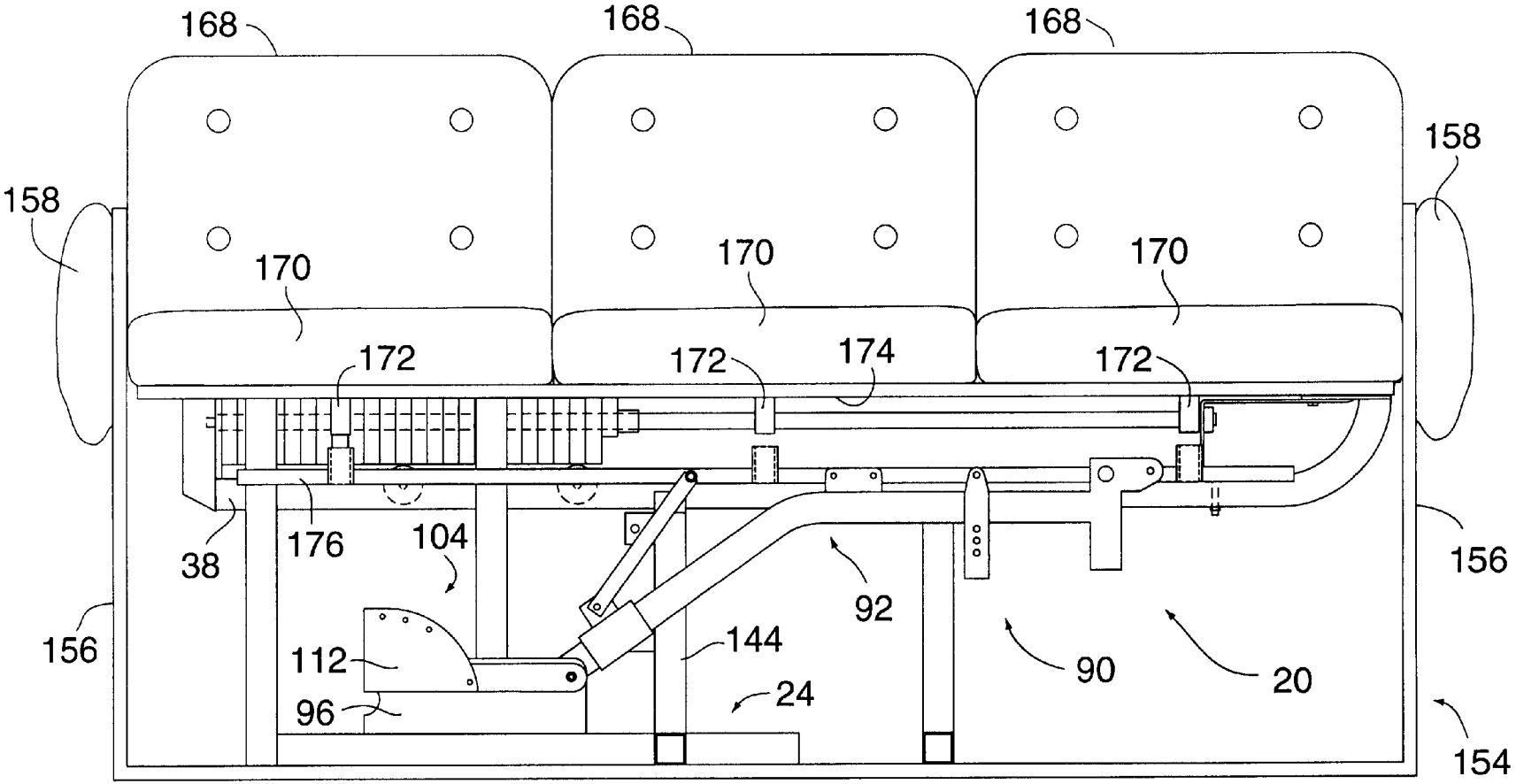
FIG. 7 is a front elevational view of the user manipulated force resisting apparatus of FIG. 1 shown functioning as an article of furniture adapted to support at least one person in a seated position.

As shown in FIG. 7, with the bench 90 in the second position and the weight retaining member 38 in the inactive position, as well as with the backrest and seat cushions, 168 and 170 respectively, installed, the convertible user manipulated force resisting apparatus of the present invention functions as an article of furniture for supporting at least one person in a seated position. While three back rest and seat cushions have been shown and described, the present invention is not limited in this regard as one, two, or a plurality of backrest and seating cushions can be provided without departing from the broader aspects of the present invention.

Figure 8:
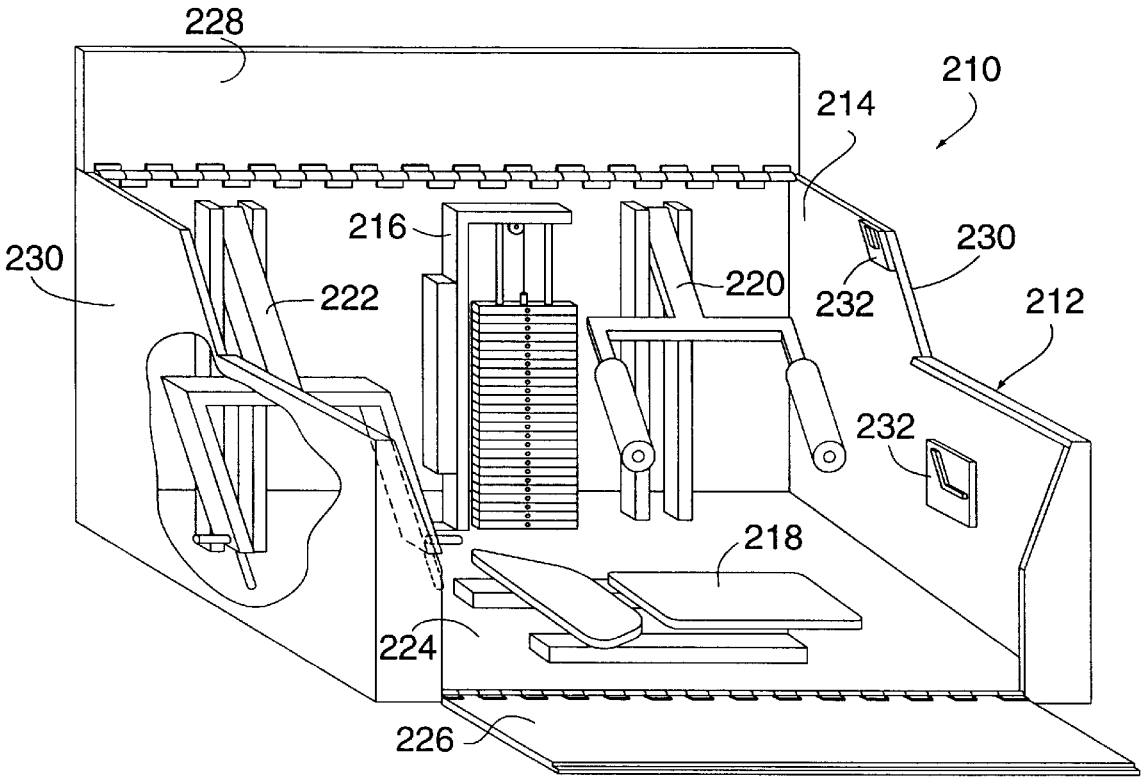
FIG. 8 is a perspective view of an alternate embodiment of the convertible user manipulated force resisting apparatus of the present invention.

An alternate embodiment of the convertible user manipulated force resisting apparatus of the present invention is illustrated in FIG. 8 and generally designated by the reference number 210. The apparatus 210 includes a frame 212 in the form of an article of furniture—a sofa in FIG. 8—and is moveable between an unfolded position as shown in FIG. 8, and a folded position. In the folded position, the frame 212 functions as an article of furniture adapted to support one or more persons in a seated position. In the unfolded position, an interior area 214 is exposed. Various different exercise apparatus can be stored in the interior area 214 and mounted to the frame 212. For example, the above-described exercise apparatus can be housed in the interior area, or as shown in FIG. 8, a weight stack 216 mounted to the frame with peripheral equipment such as a collapsible bench 218, a shoulder press 220 or a bench press 222 all cooperable with the weight stack can be supported within the interior area 214.

Still referring to FIG. 8, the frame 212 includes a base 224 and a front panel 226 hingedly attached to the frame and movable between a raised position when the frame functions as an article furniture, and a lowered position, as shown in FIG. 8, therein exposing the interior area 214. In addition, the frame 212 also includes a top panel 228 hingedly attached to the frame and movable between a lowered position, and a raised position as shown in FIG. 8 to expose the interior area 214.

Figure 9:
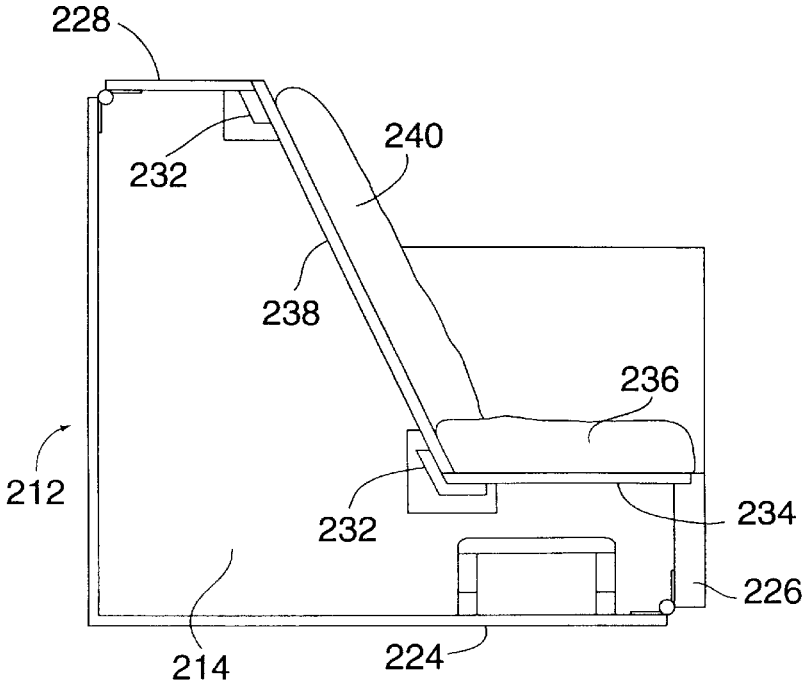
FIG. 9 is a cross-sectional side elevational view of the embodiment of FIG. 8 taken from the left side showing the seat and back cushions supported on the frame.

As shown in FIG. 9, the frame 212 includes side sections 230, one shown, having upper and lower brackets 232 mounted thereto. A lower support 234 extends across the frame 212 and is supported by the lower brackets 232 and the front panel 226. At least one seat cushion 236 is removably carried by the lower support 234. An upper support 238 is positioned on and carried by the upper and lower brackets 232. At least one backrest cushion 240 is supported on the upper support member 238.

To use the device illustrated in FIGS. 8 and 9, the cushions, 236 and 240 respectively, and the upper and lower supports, 238 and 234 respectively, are removed. Next, the front panel 226, is moved from the raised to the lowered position, and the top panel 228 is moved from the lowered to the raised position, thereby exposing the interior area 214 and the exercise apparatus housed therein. Depending on the particular exercise apparatus, stored in the interior area 214, the apparatus is then moved to a working position wherein a user can operate the equipment.

While preferred embodiments have been shown and described, various modifications and substitutions may be made without departing from the spirit and scope of the invention. Accordingly, it is to be understood that the present invention has been described by way of example, and not by limitation.

What is claimed is:

1. A convertible user manipulated force resisting apparatus comprising:

an articulated frame having a base and a weight carrying member supported on said base for movement between an active position wherein said weight carrying member extends upwardly from said base and an inactive position wherein said weight carrying member is generally horizontally disposed relative to said base;

means for releasably retaining said weight carrying member in said active position;

a plurality of discrete weights releasably secured to said weight carrying member for reciprocal motion relative thereto;

a bench coupled to said frame adjacent to said weight carrying member for movement between a first position substantially perpendicular to said weight carrying member when in said active position, and a second position approximately parallel to said weight carrying member when in said inactive position;

means for selectively moving at least one of said weights thereby generating said reciprocal motion;

means for concealing said weight carrying member and said bench when in said inactive and second positions, respectively, thereby converting said exercise apparatus to an article of furniture adapted to support at least one person in a seated position;

wherein said weight carrying member in said inactive position forms a backrest of said article of furniture and said bench in said second position forms a seat section for said article of furniture.

2. A convertible user manipulated force resisting apparatus as defined by claim 1, wherein:

said means for concealing includes a support frame mounted to said base and moveable between a folded condition wherein said support frame substantially forms said article of furniture and an unfolded condition;

said support frame defining an enclosed interior area when in said folded condition; and said exercising apparatus with said weight carrying member in said inactive position and said bench in said second position, being located in said interior area; and said support frame in said unfolded condition exposing said interior area such that said weight carrying member can be moved to said active position and said bench can be moved to said first position.

3. A convertible user manipulated force resisting apparatus, as defined by claim 2, wherein said support frame includes:

an upstanding backrest section attached to said base;

at least one upstanding side panel coupled to said base and in communication with said backrest;

at least one front panel removably attached to said base opposite said backrest section, for movement between a raised position when said support frame is in said folded condition, and a lowered position when said support frame is in said unfolded position;

at least one back cushion releasably supported on said backrest section; and at least one seat cushion member releasably supported by said side and front panels when said front panel is in said raised position.

4. A convertible user manipulated force resisting apparatus, as defined by claim 1, wherein articulated frame includes a saddle mounted to said base for cradling said weight carrying member in said inactive position.

5. A convertible user manipulated force resisting apparatus as defined by claim 4, further comprising:

a bar pivotally coupled to an upper portion of said weight carrying member for movement between a non-working position, and a working position wherein said bar extends from, and is approximately perpendicular to said weight carrying member in said active position;

retaining means for releasably retaining said bar in said working position;

a first pulley rotatably mounted to said upper portion of said weight carrying member adjacent to said bar;

at least a second pulley rotatably mounted to an end of said bar; and wherein said means for selectively moving at least one of said weights includes a cable slidably engaged with said first and second pulleys;

means coupled to one end of said cable for selectively supporting one or more of said weights, and gripping means releasably coupled at another end of said cable for allowing a user to move said one or more weights in said reciprocal motion between a lowered and a raised position.

6. A convertible user manipulated force resisting apparatus, as defined by claim 1, wherein:

said bench includes a bench frame having an articulated support surface mounted thereon;

said articulated support surface includes a stationary section and an adjustable section releasably movable to a plurality of locations between a raised and lowered position.

7. A convertible user manipulated force resisting apparatus, as defined by claim 6, wherein said means for selectively moving at least one of said weights between said raised and said lowered position includes:

a pair of levers each including a handle portion, pivotally coupled to said bench frame and selectively moveable about a pivot axis between an approximately upright position and a collapsed lower position;

means for releasably and selectively retaining said levers in a plurality of locations between said upright position and said collapsed lower position;

means for coupling said levers to one or more of said plurality of weights such that when said levers are releasably retained in one of said plurality of locations between said upright position and said collapsed lower position, said reciprocal motion of said weights can be accomplished by moving said levers about said pivot axis between a forward and rearward position.

8. A convertible user manipulated force resisting apparatus as defined by claim 1, wherein said means for concealing said weight carrying member and said bench, when in said inactive and second positions respectively includes at least one back cushion member releasably mountable to said weight carrying member, and at least one seat cushion member releasably mounted to said bench.

9. A convertible user manipulated force resisting apparatus as defined by claim 8, wherein:

at least one retainer is attached to each of said bench and said weight retaining member; and at least one boss adapted to be slidably received in said retainer, is attached to each of said seat and back cushions, such that said seat and back cushions can be releasably mounted to said bench and weight retaining member respectively by positioning said boss in said retainer.

10. A convertible user manipulated force resisting apparatus comprising:

an articulated frame having a base and a weight carrying member supported on said base for movement between an active position wherein said weight carrying member extends upwardly from said base and an inactive position wherein said weight carrying member is generally horizontally disposed relative to said base;

means for releasably retaining said weight carrying member in said active position;

a plurality of discrete weights releasably secured to said weight carrying member for reciprocal motion relative thereto;

a bench coupled to said frame adjacent to said weight carrying member for movement between a first position substantially perpendicular to said weight carrying member when in said active position, and a second position approximately parallel to said weight carrying member when in said inactive position;

means for selectively moving at least one of said weights thereby generating said reciprocal motion;

means for concealing said weight carrying member and said bench when in said inactive and second positions, respectively, thereby converting said exercise apparatus to an article of furniture adapted to support at least one person in a seated position;

wherein said means for concealing includes a support frame mounted to said base and moveable between a folded condition wherein said support frame substantially forms said article of furniture and an unfolded condition;

said support frame defining an enclosed interior area when in said folded condition;

said exercise apparatus with said weight carrying member in said inactive position and said bench in said second position being located in said interior area; and said support frame in said unfolded condition exposing said interior area such that said weight carrying member can be moved to said active position and said bench can be moved to said first position.

11. A convertible user manipulated force resisting apparatus, as defined by claim 2, wherein said support frame includes:

an upstanding backrest section attached to said base;

at least one front panel removably attached to said base opposite said backrest section, for movement between a raised position when said support frame is in said folded condition, and in a lowered position when said support frame is in said unfolded position;

at least one back cushion releasably supported on said backrest section; and at least one cushion member releasably supported by said side and front panels when said front panel is in said raised position.

* * * * *